US006735806B2

(12) United States Patent
Blum et al.

(10) Patent No.: US 6,735,806 B2
(45) Date of Patent: May 18, 2004

(54) TACKY ROLLER FOR IMPROVED SURFACE CLEANING

(75) Inventors: Ronald D. Blum, Roanoke, VA (US); Joseph A. Thibodeau, Roanoke, VA (US); William Kokonaski, Gig Harbor, WA (US); Bradley J. Blum, Roanoke, VA (US)

(73) Assignee: Eggs in the Pipeline, LLC, Roanoke, VA (US)

( * ) Notice: Subject to any disclaimer, the term of this patent is extended or adjusted under 35 U.S.C. 154(b) by 208 days.

(21) Appl. No.: 09/852,743

(22) Filed: May 11, 2001

(65) Prior Publication Data

US 2003/0033681 A1 Feb. 20, 2003

Related U.S. Application Data

(63) Continuation-in-part of application No. 09/553,234, filed on Apr. 19, 2000, now Pat. No. 6,233,776, which is a continuation-in-part of application No. 09/418,752, filed on Oct. 15, 1999, now abandoned, which is a continuation-in-part of application No. 09/304,051, filed on May 4, 1999, now Pat. No. 6,219,876.

(51) Int. Cl.[7] ..... A47L 13/12; A47L 13/26

(52) U.S. Cl. ..... 15/104.002; 15/105

(58) Field of Search ..... 15/104.002, 105, 15/114

(56) References Cited

U.S. PATENT DOCUMENTS

| | | | |
|---|---|---|---|
| 1,731,636 | A | 10/1929 | Plummer et al. |
| 1,847,046 | A | 2/1932 | Guerra |
| 2,153,686 | A | 4/1939 | Deegan, Sr. |
| 2,191,704 | A | 2/1940 | Bennett |
| 2,254,830 | A | 9/1941 | Schloss |
| 2,268,073 | A | 12/1941 | Hunn et al. |
| 2,282,672 | A | 5/1942 | Nelson |

(List continued on next page.)

FOREIGN PATENT DOCUMENTS

| | | | |
|---|---|---|---|
| DE | 26 20 235 | * | 11/1977 |
| DE | 35 00 036 | | 7/1985 |
| DE | 0 940 010 | | 5/1996 |
| EP | 0 009 891 | A1 | 4/1980 |
| EP | 0 188 005 | B2 | 7/1986 |
| EP | 0 199 537 | B1 | 10/1986 |
| EP | 0 202 846 | B1 | 11/1986 |

(List continued on next page.)

OTHER PUBLICATIONS

Advertising Materials for Alma (Advanced Laminated Material Applications, Inc.), CleanStep Contamination Control Mat. 12 pages, 1999.

Protective Products Advertisement.

Sole–Parmer Advertisement.

3m Clean–Walk Mat., 5800 Series, Technical Data, Jul. 1995.

Displaying a Winning Glow, Michael Kenward, *Technology Review*, Jan./Feb. 1999, vol 102, No. 1, 7 pages.

Screen Saviors, Michael Mattis, *Business 2.0*, ul. 1999, 1 page.

"What's New", "Intelligent Ink", Advertising Material, *Popular*, 1 pages, no date.

"Electronic Ink", Glen Sanders, ebooknet.com, 2 pages, Sep. 20, 1999.

*Primary Examiner*—Randall Chin

(74) *Attorney, Agent, or Firm*—Kenyon & Kenyon

(57) ABSTRACT

A device is disclosed for cleaning a surface. In one embodiment, the device includes a sheet having at least one tacky surface and a plurality of rollers in contact with said sheet, said plurality of rollers, in an operative embodiment, maintaining contact between said tacky surface and the surface to be cleaned.

18 Claims, 14 Drawing Sheets

U.S. PATENT DOCUMENTS

| | | | | |
|---|---|---|---|---|
| 2,430,409 | A | | 11/1947 | Osenbaugh |
| 2,512,310 | A | | 6/1950 | Corson |
| 2,601,537 | A | | 6/1952 | Lofgren |
| 2,673,042 | A | | 3/1954 | Fritzinger |
| 2,755,494 | A | | 7/1956 | Bredin |
| 2,800,215 | A | | 7/1957 | Converse |
| 2,828,501 | A | | 4/1958 | Brown, Sr. |
| 2,843,868 | A | | 7/1958 | Borgstrom |
| 2,919,456 | A | | 1/1960 | Spivey |
| 3,038,393 | A | | 6/1962 | Nappi |
| 3,078,490 | A | | 2/1963 | Etcher |
| 3,141,522 | A | | 7/1964 | Fitzpatrick |
| 3,183,116 | A | | 5/1965 | Schaar |
| 3,300,275 | A | | 1/1967 | Lorman |
| 3,400,421 | A | | 9/1968 | Nappi |
| 3,430,496 | A | * | 3/1969 | Swanberg |
| 3,435,481 | A | | 4/1969 | Kessler |
| 3,501,797 | A | | 3/1970 | Nappi |
| 3,517,407 | A | | 6/1970 | Wyant |
| 3,578,738 | A | | 5/1971 | Hughes |
| 3,663,980 | A | | 5/1972 | Conklin |
| 3,696,459 | A | | 10/1972 | Kucera et al. |
| 3,699,926 | A | | 10/1972 | Stockl |
| 3,717,897 | A | | 2/1973 | Amos et al. |
| 3,785,102 | A | | 1/1974 | Amos |
| 3,886,620 | A | | 6/1975 | Miller |
| 3,906,578 | A | | 9/1975 | Huber |
| 3,909,996 | A | | 10/1975 | Ettlinger, Jr. et al. |
| 4,083,075 | A | | 4/1978 | Hester |
| 4,107,811 | A | | 8/1978 | Imsande |
| 4,126,854 | A | | 11/1978 | Sheridon |
| 4,128,909 | A | * | 12/1978 | Kawabe |
| 4,143,103 | A | | 3/1979 | Sheridon |
| 4,143,194 | A | | 3/1979 | Wihksne |
| 4,328,275 | A | | 5/1982 | Vargo |
| 4,353,944 | A | | 10/1982 | Tarui |
| 4,421,809 | A | | 12/1983 | Bish et al. |
| 4,433,451 | A | | 2/1984 | Parisi |
| 4,435,451 | A | | 3/1984 | Neubert |
| 4,439,474 | A | | 3/1984 | Sagel |
| 4,482,593 | A | | 11/1984 | Sagel et al. |
| 4,484,250 | A | | 11/1984 | Rzepecki et al. |
| 4,510,642 | A | | 4/1985 | Ingermann et al. |
| 4,550,467 | A | | 11/1985 | Johnson et al. |
| 4,559,250 | A | | 12/1985 | Paige |
| 4,564,546 | A | | 1/1986 | Jones |
| 4,575,890 | A | | 3/1986 | Hidle |
| 4,609,580 | A | | 9/1986 | Rockett et al. |
| 4,614,679 | A | | 9/1986 | Farrington, Jr. |
| 4,640,539 | A | | 2/1987 | La Porte |
| 4,707,895 | A | | 11/1987 | Lang |
| 4,720,789 | A | | 1/1988 | Hector et al. |
| 4,798,754 | A | | 1/1989 | Tomek |
| 4,822,669 | A | | 4/1989 | Roga |
| 4,917,975 | A | | 4/1990 | De Guzman |
| 4,959,265 | A | | 9/1990 | Wood |
| 5,018,235 | A | | 5/1991 | Stamatiou et al. |
| 5,071,628 | A | | 12/1991 | Alazet |
| 5,092,699 | A | | 3/1992 | Silvenis |
| 5,142,733 | A | | 9/1992 | Mogel |
| 5,204,159 | A | | 4/1993 | Tan |
| 5,280,664 | A | * | 1/1994 | Lin |
| 5,293,660 | A | | 3/1994 | Park |
| 5,335,788 | A | | 8/1994 | Beasley et al. |
| 5,344,693 | A | | 9/1994 | Sanders |
| 5,461,748 | A | | 10/1995 | Koiduka |
| 5,500,267 | A | | 3/1996 | Canning |
| 5,556,685 | A | | 9/1996 | Swicegood, Jr. |
| 5,562,580 | A | | 10/1996 | Beasley et al. |
| 5,571,626 | A | | 11/1996 | Cumming et al. |
| 5,589,246 | A | | 12/1996 | Calhoun |
| 5,604,027 | A | | 2/1997 | Sheridon |
| 5,658,637 | A | | 8/1997 | Volz |
| 5,723,204 | A | | 3/1998 | Stefik |
| 5,763,038 | A | | 6/1998 | Wood |
| 5,815,995 | A | | 10/1998 | Adam |
| 5,826,874 | A | | 10/1998 | Teitell et al. |
| 5,839,976 | A | | 11/1998 | Darr |
| 5,869,350 | A | | 2/1999 | Heeger et al. |
| 5,878,457 | A | | 3/1999 | Cox et al. |
| 5,933,900 | A | | 8/1999 | Wang |
| 5,943,722 | A | | 8/1999 | Hamilton et al. |
| 5,945,502 | A | | 8/1999 | Hsieh et al. |
| 6,001,456 | A | | 12/1999 | Newland |
| 6,223,378 | B1 | | 5/2001 | Watellier |

FOREIGN PATENT DOCUMENTS

| | | | | |
|---|---|---|---|---|
| EP | 0 353 139 | | | 1/1990 |
| EP | 0 354 281 | A1 | | 2/1990 |
| EP | 0 359 478 | A2 | | 3/1990 |
| EP | 0 365 869 | A1 | | 5/1990 |
| EP | 0 374 860 | A3 | | 6/1990 |
| EP | 0 421 258 | A1 | | 4/1991 |
| EP | 0 448 768 | A1 | | 10/1991 |
| EP | 0 512 904 | A2 | | 11/1992 |
| EP | 0 514 191 | A1 | | 11/1992 |
| EP | 0 554 641 | A1 | | 8/1993 |
| EP | 0 573 277 | A1 | | 12/1993 |
| EP | 0 624 125 | B1 | | 11/1994 |
| EP | 0 624 681 | A2 | | 11/1994 |
| EP | 0 648 834 | A1 | | 4/1995 |
| EP | 0 751 213 | A1 | | 1/1997 |
| EP | 0 794 244 | A1 | | 9/1997 |
| EP | 0 839 900 | A1 | | 5/1998 |
| EP | 0 895 745 | A1 | | 2/1999 |
| EP | 0 971 064 | A2 | | 1/2000 |
| FR | 2 736 533 | | | 1/1997 |
| GB | 2 263 393 | | * | 7/1993 |
| JP | 02077224 | A | | 3/1990 |
| JP | 406090891 | | | 4/1994 |
| JP | 7227375 | A | | 8/1995 |
| JP | 7327912 | A | | 12/1995 |
| JP | 10005159 | A | | 1/1998 |
| JP | 10057728 | A | | 3/1998 |
| JP | 11019024 | A | | 1/1999 |
| JP | 11104052 | A | | 4/1999 |
| JP | 2001037699 | A | | 2/2001 |
| WO | 9108701 | | | 6/1991 |
| WO | WO 00/07811 | | | 2/2000 |
| WO | WO 00/16682 | | | 3/2000 |
| WO | WO 00/19871 | | | 4/2000 |
| WO | WO 00/29209 | | | 5/2000 |

* cited by examiner

TACKY ROLLER FOR IMPROVED SURFACE CLEANING

CROSS-REFERENCES TO RELATED APPLICATIONS

This application is a continuation-in-part of U.S. application Ser. No. 09/553,234, filed Apr. 19, 2000, and issuing as U.S. patent Ser. No. 6,233,776 on May 22, 2001, U.S. application Ser. No. 09/553,234 is a continuation-in-part of U.S. application Ser. No. 09/418,752, filed Oct. 15, 1999 and now abandoned U.S. application Ser. No. 09/418,752 is a continuation-in-part of U.S. application Ser. No. 09/304,051, filed May 4, 1999, and issuing as U.S. patent Ser. No. 6,219,876 on Apr. 24, 2001. Each of the foregoing applications is incorporated in its entirety herein by reference.

FIELD OF THE INVENTION

The present invention relates to the field of cleaning, and, more particularly, to a device, method, and system for cleaning various surfaces.

BRIEF DESCRIPTION OF THE DRAWINGS

The invention will be more readily understood through the following detailed description, with reference to the accompanying drawings, in which.

DETAILED DESCRIPTION

The present invention relates to cleaning various surfaces by employing a tacky surface or sheet on a series of rollers.

Some known devices for cleaning surfaces, such as floors, utilize a single roll of perforated sheets having a tacky surface. One problem that arises with these devices is the repeated need for tearing or cutting away the tacky sheets once those sheets become soiled. Furthermore, removing the soiled sheets requires that the user's hands come in contact with the dirt and/or other debris attached to the tacky surface. Also, known tacky roll devices can not work effectively on many surfaces, such as thickly piled carpet, grooved wood floors, grout-separated tile floors, mortar-jointed brick floors, etc., because the known tacky roll devices have little, if any ability to penetrate cracks, crevasses, and deeper layers of carpet, etc.

Figure 1:
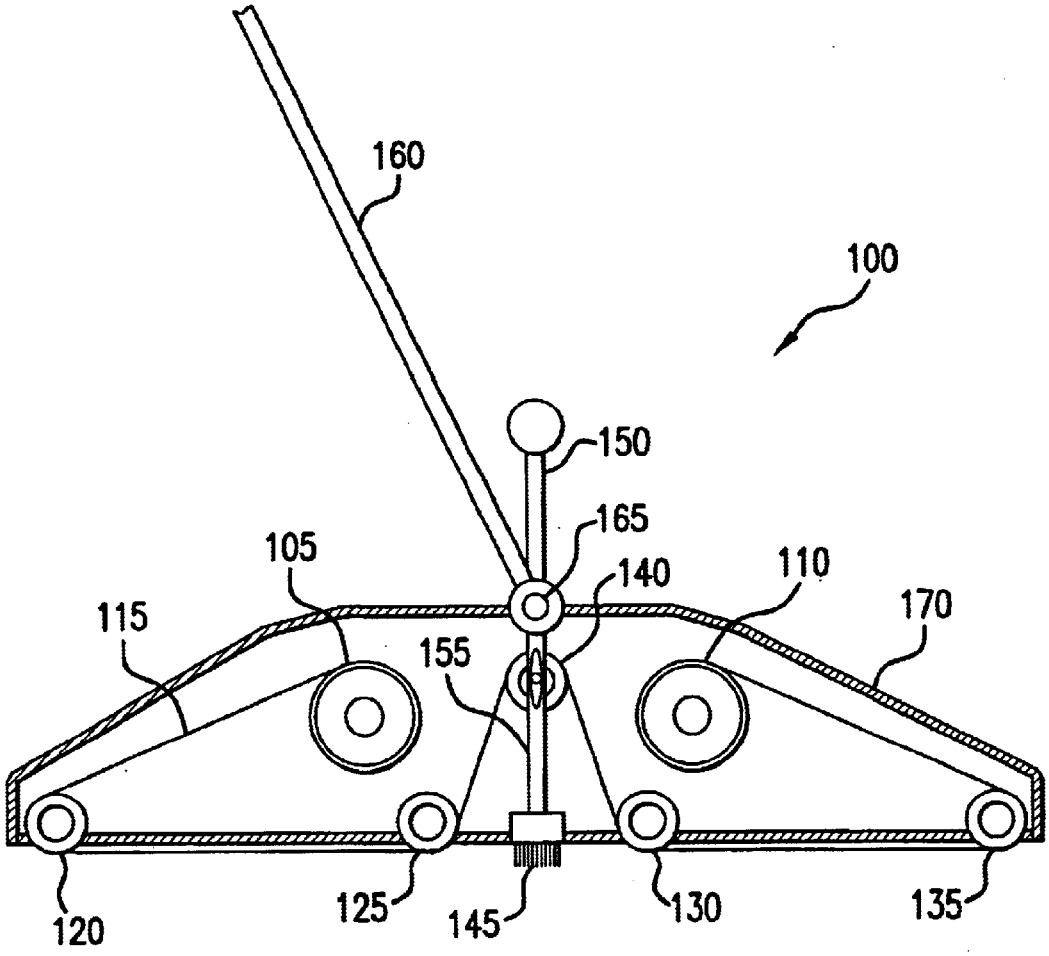
FIG. 1 is a side view of an exemplary embodiment of a rolling cleaning system 100 of the present invention.
Figure 2A:
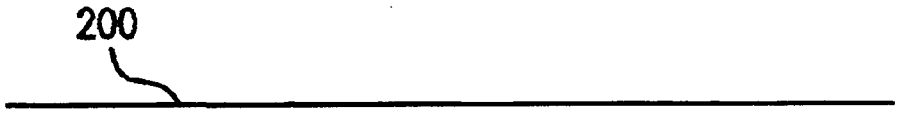
FIGS. 2A–2D are side views of an exemplary selection of surfaces that can be cleaned using certain embodiments of the present invention.
Figure 2B:
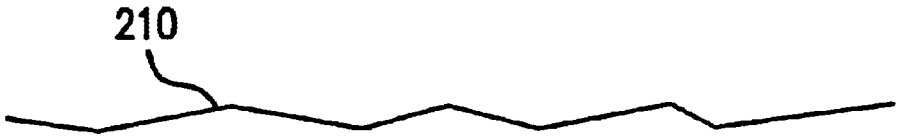
Figure 2C:
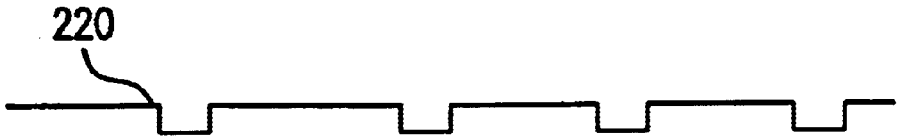
Figure 2D:
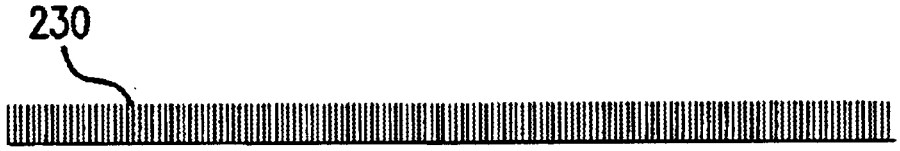

FIG. 1 is a side view of an exemplary embodiment of a rolling cleaning system 100 of the present invention. Rolling cleaning system 100 can include two large internal rollers 105, 110 for storing and/or dispensing a continuous long sheet 115 having at least one tacky surface. Tacky sheet 115 can be, by way of example only, plastic or paper coated with an acrylic based adhesive with sufficient tack as to be useful in removing dirt and/or debris from a variety of surfaces. The tack can range between any two integer values in the numerical range of 50 to 500 g/25 mm, with a preferred range of tack between 200 to 300 g/25 mm.

Tacky sheet 115 can be rolled across the floor or surface via four contact rollers 120, 125, 130, 135. These contact rollers can be constructed from, for example, plastic, rubber, foam rubber, and/or metal, etc. A take-up roller 140 can be used to create a space for the introduction of a brush 145, and/or to remove slack from tacky sheet 115. Brush 145 can have stiff bristles, which can be constructed from, for example, nylon, plastic, natural fiber, animal hair, and/or metal, etc. The height of brush 145 can be adjusted by raising or lowering handle 150, which can be attached to shaft 155, which can connect brush 145 to a housing 170.

A large handle 160 can be used to push rolling cleaning system 100 across the floor or whatever surface is to be cleaned. Handle 160 can be pivotably, rotatably, and/or swivelably mounted on a pivot or pin 165, in a manner well known in the art, to allow rolling cleaning system 100 to be pushed from either direction. By allowing rolling cleaning system 100 to be rolled in either direction, tacky sheet 115 can be dispensed or wound on either internal roller 105, 110 depending upon the direction rolling cleaning system 100 is being pushed or pulled across the floor. Rolling cleaning system 100 can be at least partially surrounded by enclosure 170, which can be constructed of, for example, plastic and/or metal.

Internal rollers 105, 110 can be constructed of, for example, plastic and/or metal, and can be rotationally spring-loaded and/or clutched, e.g., akin to a window blind, to maintain tension in tacky sheet 115 and/or to facilitate the retrieval and/or advancement thereof. Tacky sheet 115 can be provided on, for example, one or two rollers sleeves (not shown) that can be placed onto or over one or both of internal rollers 105, 110. A roller sleeve can be constructed of, for example, cardboard, plastic, and/or metal. To avoid rotational slippage between the sleeve and the roller, the sleeves could be, for example, wider than the tacky sheet and secured to the roller with end caps, clamps or rubber bands.

After several uses, tacky sheet 115 can be completely wound back onto a roller sleeve and discarded. This can be accomplished by rolling the rolling cleaning system 100 in the same direction until tacky sheet 115 has completely spooled onto one roller sleeve. Also, this can be accomplished by way of a spring loaded auto advance (not shown)

that can be manually activated. The auto-advance can be accomplished pushing a button on the handle or the base of the cleaning system that locks the roller with the sleeve that has the unused portion of the tacky sheet, at the same time this button would release the clamping force on the sleeve on this roller, allowing the sleeve to slip and rotate or slip around the roller (much like a roll of paper towels on a fixed post), as the spring forces in the opposing roller advances the tacky sheet forward and onto the unlocked roller. Further, advancing the adhesive sheet onto the roller sleeve can be accomplished by using an electric motor (not shown). The motor could be attached to one of the roller, preferable the roller without the unused reserve portion of tacky sheet. Again by pushing a button the roller with the tacky sheet would be locked, the clamp that holds the sleeve onto this roller would be released, allowing the sleeve to rotate or slip about the roller. The motor on the opposing roller would then turn this roller and advance the tacky sheet forward and onto the motorized roller. The roller sleeve could advance when the user, for example, pushes a button, turns a knob, and/or squeezes a lever, etc. The electric motor can receive power by either plugging the rolling cleaning system 100 into a power outlet, or by charging a battery to be used by the rolling cleaning system 100.

FIG. 2 is a side view of an exemplary selection of surfaces that can be cleaned using certain embodiments of the present invention. Surface 200 represents a very smooth and/or flat surface, such as tightly-joined hardwood or marble flooring, certain types of vinyl flooring, smoothly painted drywall, or even smooth concrete. Such surfaces would most likely not require the brush 145 illustrated in FIG. 1.

Surface 210 represents a much rougher surface, such as worn concrete, black top, or a heavily textured fabric. Such surfaces would likely be cleaned more effectively with the brush illustrated in FIG. 1 in the down position.

Surface 220 represents a grouted tile or brick flooring surface, or a grooved fabric such as corduroy, that would benefit from use of the brush to removed dirt and debris from the grooves or grout lines.

Surface 230 represents a carpeted or heavily napped surface that would also be cleaned more effectively with the brush in FIG. 1 in the down position. While these examples illustrate a wide range of surfaces, other surfaces may also be cleaned with the present invention, including, for example, any or nearly any type of flooring, wall, and/or ceiling surface, and/or any or nearly any type of fabric.

In situations where the fabric is part of a garment or small item of furniture, an embodiment of the present invention could be rather small, perhaps less than a few inches wide. In the case of cleaning floors, an embodiment of the present invention could be twelve or more inches wide. In industrial applications, an embodiment of the present invention can be several feet wide. For use outdoors, such as on concrete, asphalt, or artificial surfaces, e.g., Astroturf, an embodiment of the present invention can be up to many yards wide.

Figure 3:
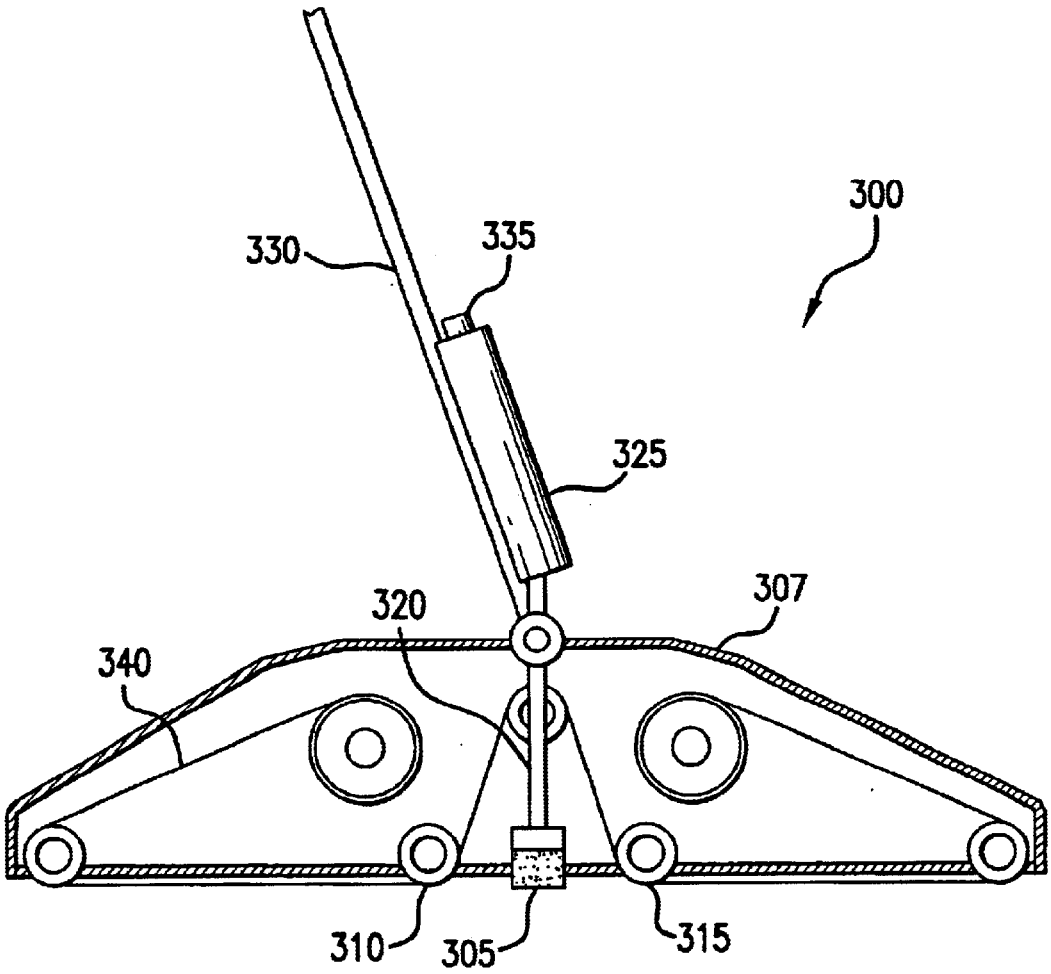
FIG. 3 is a side view of an exemplary embodiment of a rolling cleaning system 300 of the present invention.

FIG. 3 is a side view of an exemplary embodiment of a rolling cleaning system 300 of the present invention. Instead of the brush shown in FIG. 1, a sponge 305 can be placed between internal rollers 310, 315. Shaft 320 can connect sponge 305 to the rest of the assembly and/or to the housing 307, and can contain a tube 320 that feeds cleaning solution from a reservoir 325 into the sponge 305. The action of sliding sponge 305 across the floor can draw the cleaning solution down tube 320. Reservoir 325 can be attached to handle 330 and/or to the housing and can contain a cap 335 that can be removed to add cleaning solution and/or water to reservoir 325.

Tacky sheet 340 can be coated with a tacky adhesive that is effective when wet, such as, for example, an adhesive selected from a group consisting of: natural rubber in the presence of a plasticizer mixed with a hydrocolloid gum, synthetic rubber in the presence of a plasticizer mixed with a hydrocolloid gum, or polymeric adhesives consisting of co-polymers of 2-amino ethyl ethacrylate, and n-butyl methacrylate.

Another possible adhesive system would include a single blended adhesive with wet and dry properties. One class of materials, for example, could include the blending of certain hydrocolloid gums (e.g., gaur gum, locust bean gum, etc.) with certain pressure sensitive adhesive systems to improve tack of the moistened adhesive. Since these materials have a large capacity for absorbing moisture, they should provide good wet adhesive or tackiness. Possible pressure sensitive adhesives include many synthetic and natural rubbers in the presence of plasticizers, such as, polyisobutylenes, natural rubber, silicone rubbers, acrylonitrile rubbers, polyurathane rubbers, butyl rubber elastomer, etc. Such mixtures can be further enhanced by the introduction of natural and artificial fibrous materials, such as wood cellulose, cotton, or Dacrun. The introduction of these fibrous materials helps to improve the cohesive forces of the adhesive system.

Figure 4:
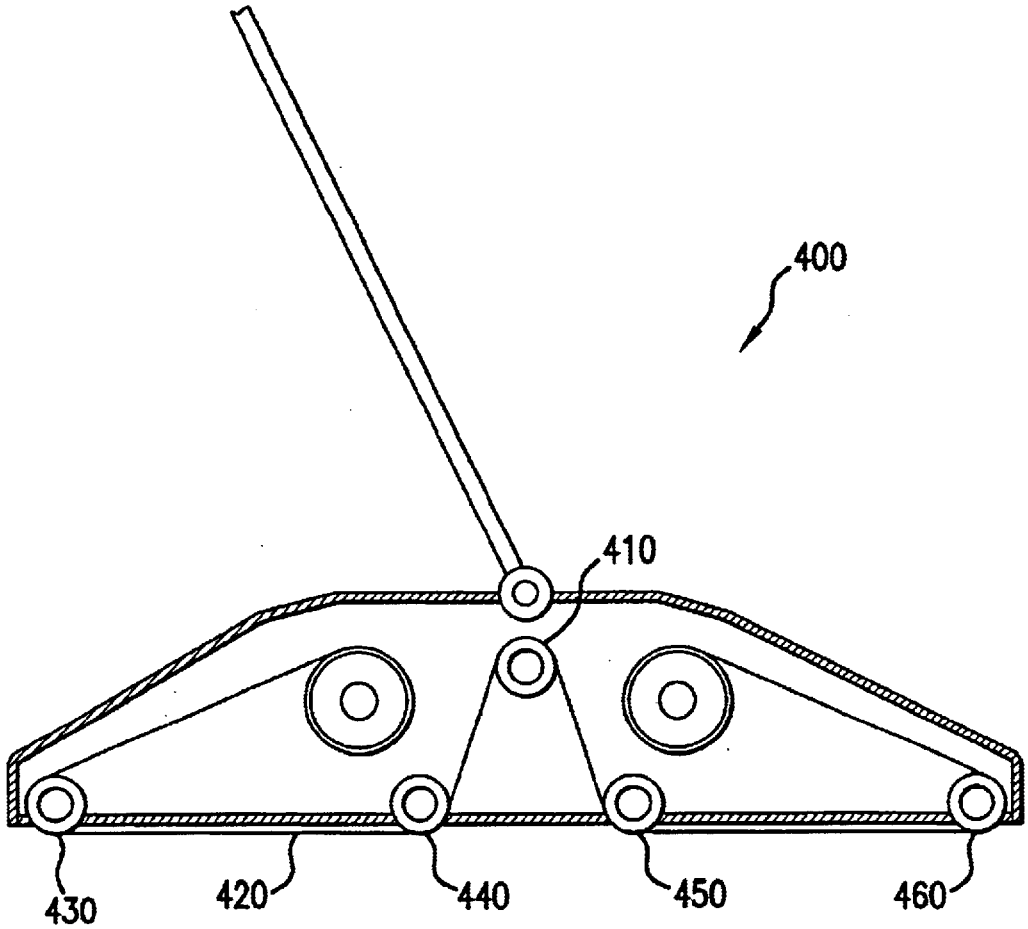
FIG. 4 is a side view of an exemplary embodiment of a rolling cleaning system 400 of the present invention.

FIG. 4 is a side view of an exemplary embodiment of a rolling cleaning system 400 of the present invention. This embodiment is similar to the exemplary embodiments illustrated in FIG. 1 and FIG. 3, except that neither a brush nor a sponge is provided. Instead, in this exemplary embodiment, rolling cleaning system 400 can have a center roller 410 that serves as a means of removing slack in tacky sheet 420 as tacky sheet 420 slides across the surface or floor being cleaned. Such a device could be particularly useful on smooth surfaces. Further, rolling cleaning system 400 could be useful on non-smooth surfaces if rollers 430, 440, 450, 460 are coated and/or constructed from a compressible foam rubber or other substance that would allow tacky sheet 420 to be pushed into crevices of an uneven surface, such as shown in element 210 of FIG. 2.

Figure 5:
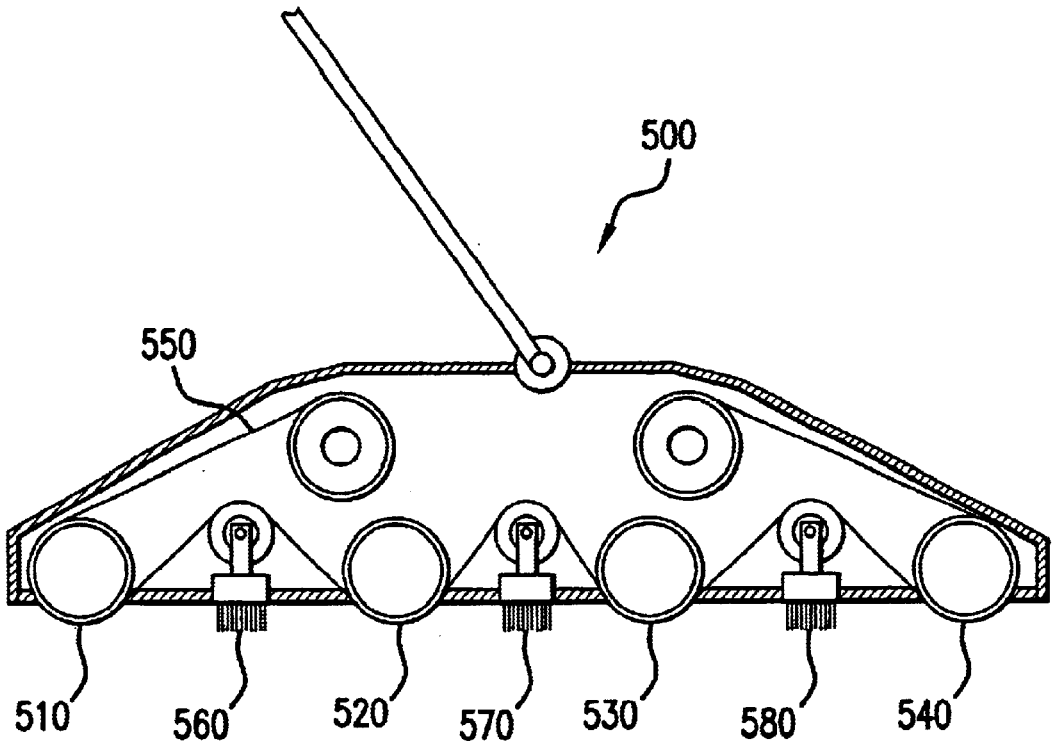
FIG. 5 is a side view of an exemplary embodiment of a rolling cleaning system 500 of the present invention.

FIG. 5 is a side view of an exemplary embodiment of a rolling cleaning system 500 of the present invention. In this embodiment, cleaning device 500 has a set of contact rollers 510, 520, 530, 540 that allows the tacky sheet 550 to be rolled across the surface rather than slid across the surface as in the earlier embodiments. In some embodiments, contact rollers 510, 520, 530, and/or 540 can be rotationally fixed, thereby serving as guides for tacky sheet 550. In other embodiments, contact rollers 510, 520, 530, and/or 540 can freely rotate. Such a roller action may improve the effectiveness of the tacky surface in its ability to lift dirt and/or debris from a surface. Brushes 560, 570, 580 are located between contact rollers 510, 520, 530, 540 to loosen and/or remove debris that is on the surface and/or in cracks or crevices.

Figure 6:
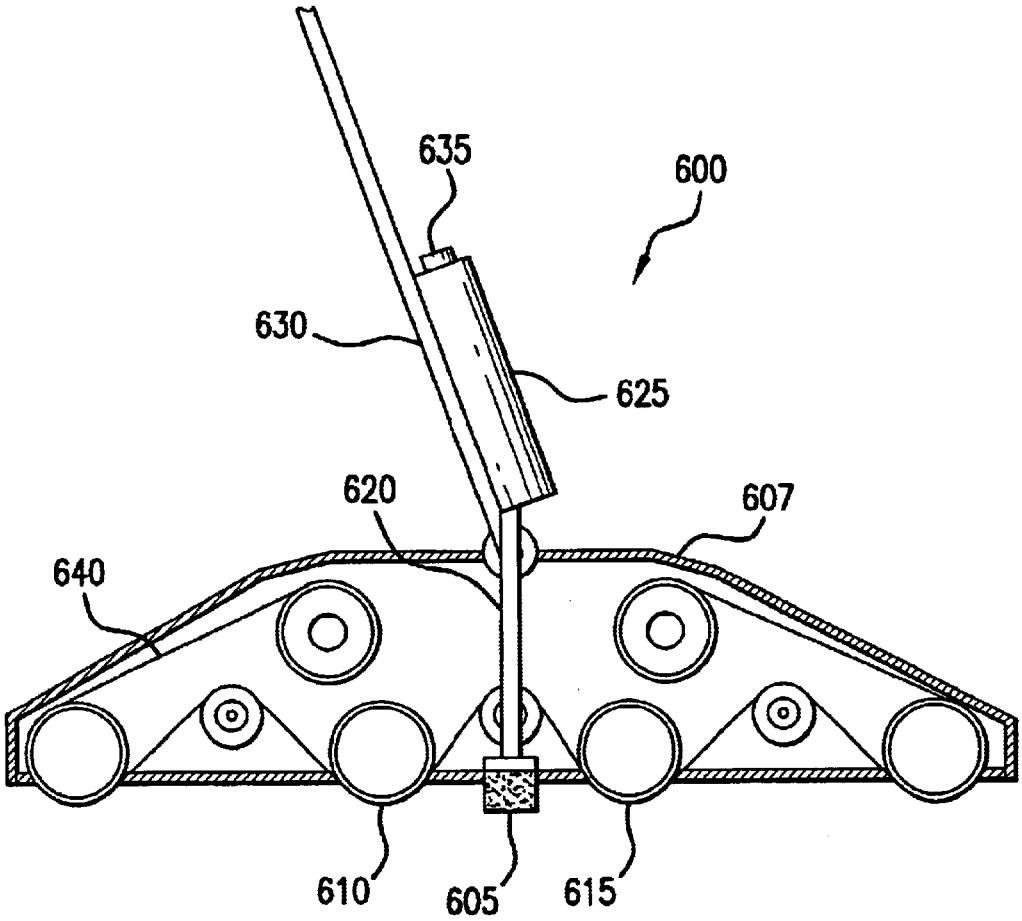
FIG. 6 is a side view of an exemplary embodiment of a rolling cleaning system 600 of the present invention.

FIG. 6 is a side view of an exemplary embodiment of a rolling cleaning system 600 of the present invention. In this embodiment, instead of the brush shown in FIG. 5, a sponge 605 is placed between rollers 610, 615. The shaft 620 that connects sponge 605 to the rest of the assembly and/or to the housing 607 contains a tube and/or channel (not shown) that feeds and/or wicks cleaning solution from a reservoir 625 into sponge 605. Alternatively, the action of sliding sponge 605 across the floor can draw the cleaning solution down the tube. Reservoir 625 is attached to the handle 630 and contains a cap 635 that can be removed to add cleaning solution and/or water to the reservoir. In this embodiment, tacky sheet 640 will be coated on at least its cleaning side with a tacky adhesive that is effective when wet, and possibly on the non-cleaning side with a waterproof or water resistant coating.

Figure 7:
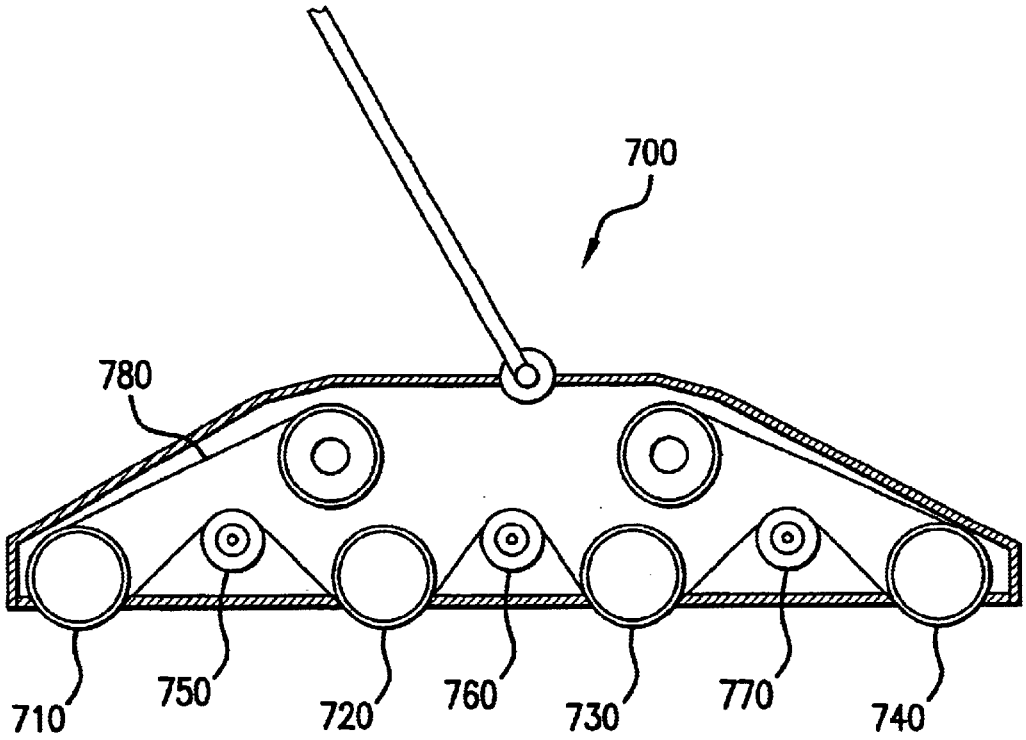
FIG. 7 is a side view of an exemplary embodiment of a rolling cleaning system 700 of the present invention.

FIG. 7 is a side view of an exemplary embodiment of a rolling cleaning system 700 of the present invention. Rolling cleaning system 700 is similar in certain respects to rolling cleaning systems 500 and 600 of FIGS. 5 and 6 respectively, except that rolling cleaning system 700 does not include a brush or a sponge. Rolling cleaning system 700 has a set of contact rollers 710, 720, 730, 740 that can assist in keeping tacky sheet 780 in contact with the surface to be cleaned, and can help with advancing tacky sheet 780 as rolling cleaning system 700 is moved across that surface. Several take-up rollers 750, 760, 770, which can be spring-loaded in the up-down direction (as determined by the operation of system 700 on a floor), can provide a means of removing any slack that arises in tacky sheet 780.

Figure 8:
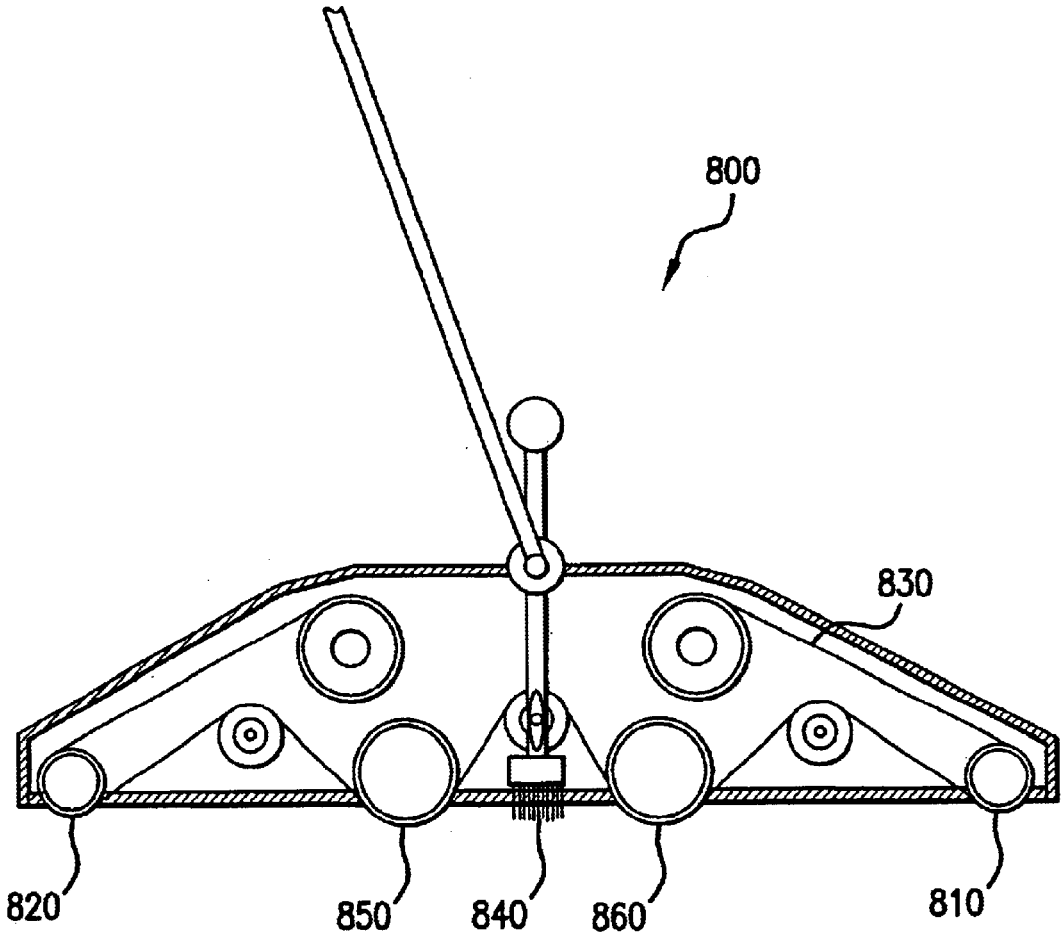
FIG. 8 is a side view of an exemplary embodiment of a rolling cleaning system 800 of the present invention.

FIG. 8 is a side view of an exemplary embodiment of a rolling cleaning system 800 of the present invention. In this embodiment, contact rollers 810, 820 850, and 860 assist with keeping tacky sheet 830 in contact with the surface to be cleaned. External contact rollers 810, 820 are smaller than internal contact rollers 850, 860, so that rolling cleaning system 800 can reach under counters and other places that would be hard to reach if all four contact rollers were the same size. Also, adjustable brush 840 can be located between internal contact rollers 850, 860.

Figure 9:
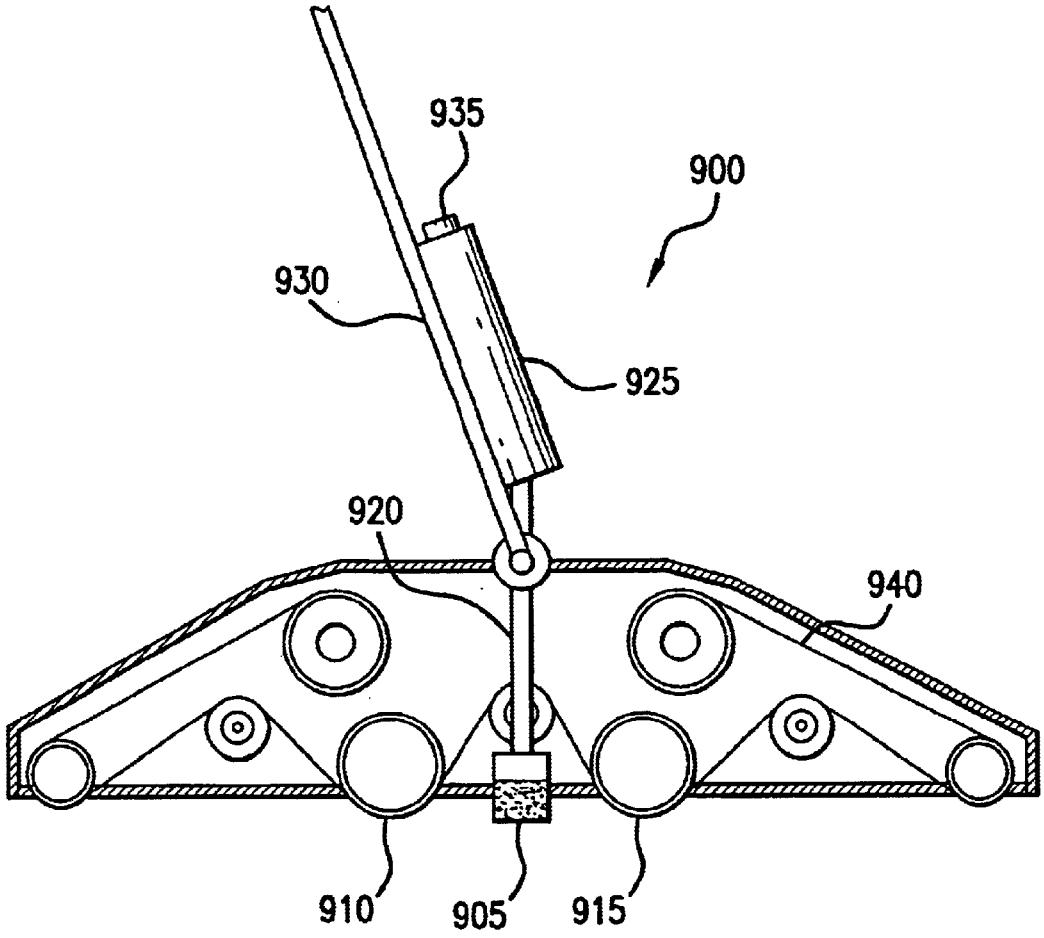
FIG. 9 is a side view of an exemplary embodiment of a rolling cleaning system 900 of the present invention.

FIG. 9 is a side view of an exemplary embodiment of a rolling cleaning system 900 of the present invention. In this cleaning device, a sponge 905 is placed between the two internal contact rollers 910, 915 instead of the brush shown in FIG. 8. Shaft 920 can connect sponge 905 to the rest of rolling cleaning system 900. Cleaning solution can flow from reservoir 925 into sponge 905 via a fluidly-coupled channel or tube (not shown) in shaft 920. The action of sliding sponge 905 across the surface to be cleaned can draw the cleaning solution down the tube. Reservoir 925 is attached to handle 930 and contains a cap 935 that can be removed to add cleaning solution or water to reservoir 925.

Figure 10:
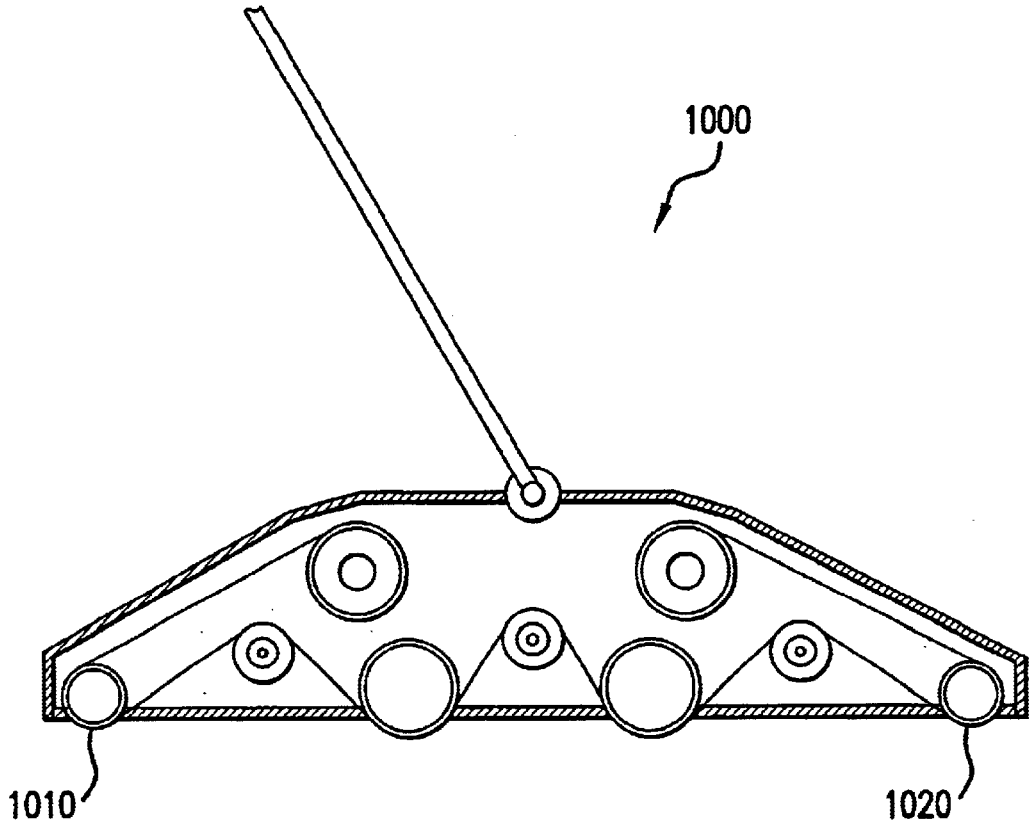
FIG. 10 is a side view of an exemplary embodiment of a rolling cleaning system 1000 of the present invention.

FIG. 10 is a side view of an exemplary embodiment of a rolling cleaning system 1000 of the present invention. This embodiment is similar to those described in FIGS. 8 and 9. In this embodiment, cleaning device 1000 has smaller external contact rollers 1010, 1020 on either end, but does not contain a brush or a sponge.

Although the embodiments described in FIGS. 1 through 10 contain multiple rollers in contact with the surface to be cleaned, fewer rollers are possible, in fact only one roller could be used in the simplest device. Thus, although not every possible combination of rollers, brushes, and sponges is illustrated herein, the general scope of the present invention includes such variations of the embodiments described herein.

Figure 11:
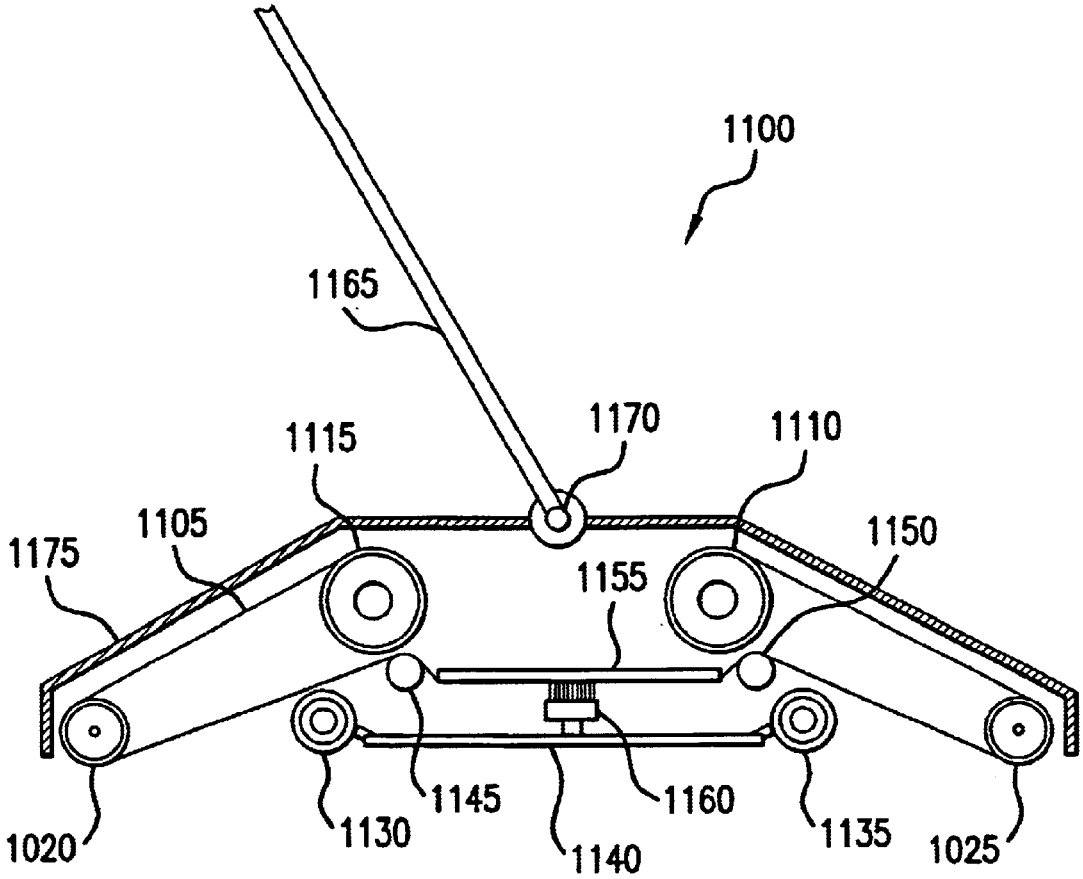
FIG. 11 is a side view of an exemplary embodiment of a rolling cleaning system 1100 of the present invention.

FIG. 11 is a side view of an exemplary embodiment of a rolling cleaning system 1100 of the present invention. In this embodiment, the cleaning device 1100 contains a tacky sheet 1105 that can be advanced or dispensed from one of two sheet rollers 1110, 1115 depending upon the direction in which the device is rolled across the surface. Tacky sheet 1105 can be held in contact with the surface to be cleaned by two external contact rollers 1120, 1125. Two brush rollers 1130, 1135 are also attached to the base of the rolling cleaning device 1100 on either side of a collection pan 1140. Brush rollers 1130, 1135 can pick up dirt and/or debris from the surface. That dirt and/or debris can then attach itself to the tacky surface of sheet 1105. Alternatively, or in combination, brush rollers 1130, 1135 can drop the dirt and/or debris into collection pan 1140.

Tacky sheet 1105 can be guided along a flat planar guide 1155 inside device 1100 by two small guide rollers 1145, 1150. As tacky sheet 1105 slides across guide 1155, tacky sheet 1105 can come in contact with a sheet brush 1160 that can remove any large pieces of loosely attached debris, whereby that debris can be deposited on collection pan 1140.

Device 1100 can have a handle 1165, as in previous embodiments, which can be flipped about a pivot or pin 1170 to change the direction of the device. As in previously-described embodiments, certain components of device 1100, such as rollers 1110, 1115, 1120, 1125, 1130, 1135, 1145, and/or 1150, tacky sheet 1105, collection pan 1140, and/or brush 1160, can also be at least partially enclosed in a case, chassis, or housing 1175 made from, by way of example only, plastic or metal. External contact rollers 1120, 1125, and brush rollers 1130, 1135, can be constructed of plastic, rubber, or other suitable material.

Figure 12:
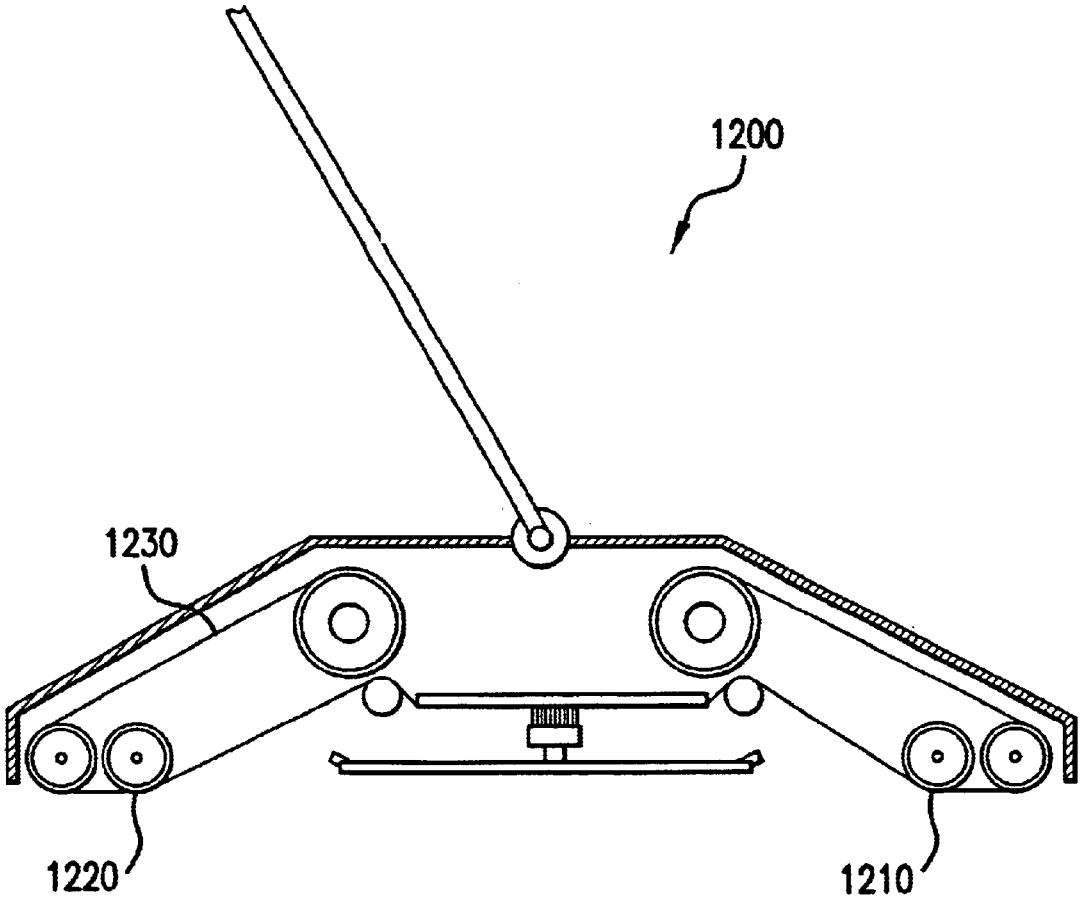
FIG. 12 is a side view of an exemplary embodiment of a rolling cleaning system 1200 of the present invention.

FIG. 12 is a side view of an exemplary embodiment of a rolling cleaning system 1200 of the present invention, which is similar in certain respects to the embodiment illustrated in FIG. 11. In this embodiment, however, device 1200 has two additional external contact rollers 1210, 1220 instead of two brush rollers. External contact rollers 1210, 1220 can allow more surface area of tacky sheet 1230 to come in contact with the surface to be cleaned at any given instant.

Figure 13:
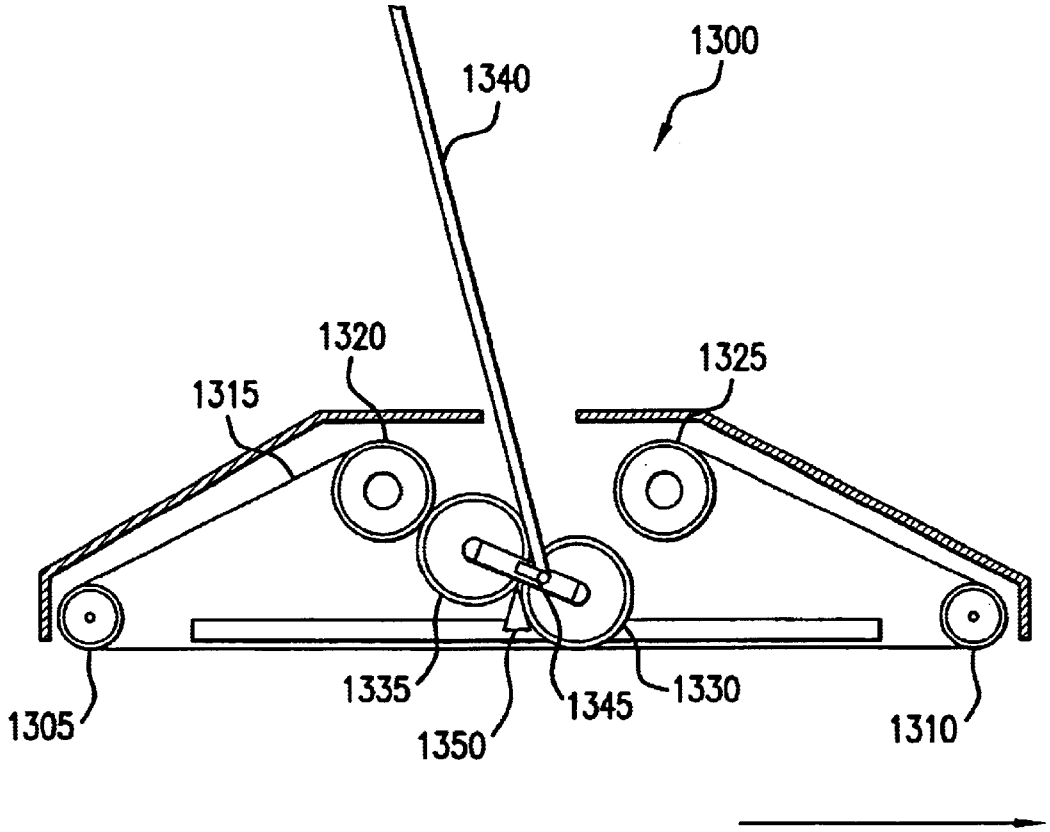
FIG. 13 is a side view of an exemplary embodiment of a rolling cleaning system 1300 of the present invention.

FIG. 13 is a side view of an exemplary embodiment of a rolling cleaning system 1300 of the present invention. Device 1300 has two external contact rollers 1305, 1310 that can help move tacky sheet 1315 across the surface to be cleaned. Tacky sheet 1315 can be advanced onto or removed from one of the two larger sheet rollers 1320, 1325 inside device 1300, depending on the direction device 1300 is moving across the surface.

When device 1300 is moved in the direction of the arrow shown in FIG. 13, friction between tacky sheet 1315 and the surface to be cleaned causes tacky sheet 1315 to move opposite to the direction of the arrow. Friction between tacky sheet 1315 and drive roller 1330 causes drive roller 1330 to rotate in the clockwise direction. By virtue of the contact between drive roller 1330 and driven roller 1335, driven roller 1335 rotates in the counter-clockwise direction. Since driven roller 1335 is in contact with sheet roller 1320, this contact causes sheet roller 1320 to rotate in the clockwise direction which has the effect of pulling tacky sheet 1315 onto sheet roller 1320. As the diameter of sheet roller 1320 increases due to the accumulation of tacky sheet 1315 therearound, driven roller 1335 stays in contact with sheet roller 1320 by pivoting further up into the housing. The continuous tacky sheet can be spooled onto sheet roller 1325 and off of sheet roller 1320 by reversing the direction device 1300 is moving across the floor. This is done by moving handle 1340 to the right and swiveling handle 1340 about a linkage 1345 that causes the drive roller 1330 and driven roller 1335 to pivot about a pivot point 1350. When this happens the whole process is reversed and tacky sheet 1315 is now wound onto sheet roller 1325.

Figure 14A:
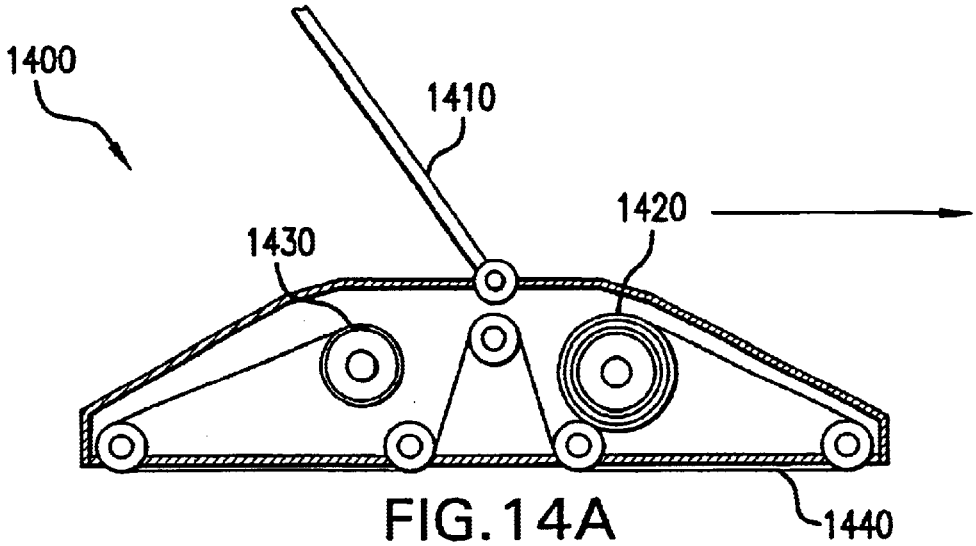
FIG. 14A is a side view of an exemplary embodiment of a rolling cleaning system 1400 of the present invention moving in a first direction.

FIGS. 14A, B, and C illustrate the advancement of material from one roller to the other.

In FIG. 14A, the rolling cleaning device 1400 is shown with most of the tacky sheet 1440 spooled up and onto the front roller 1420, with very little tacky sheet spooled onto the rear roller 1430. The handle 1410 is tilted to the left and the device is pushed across the surface to the right.

Figure 14B:
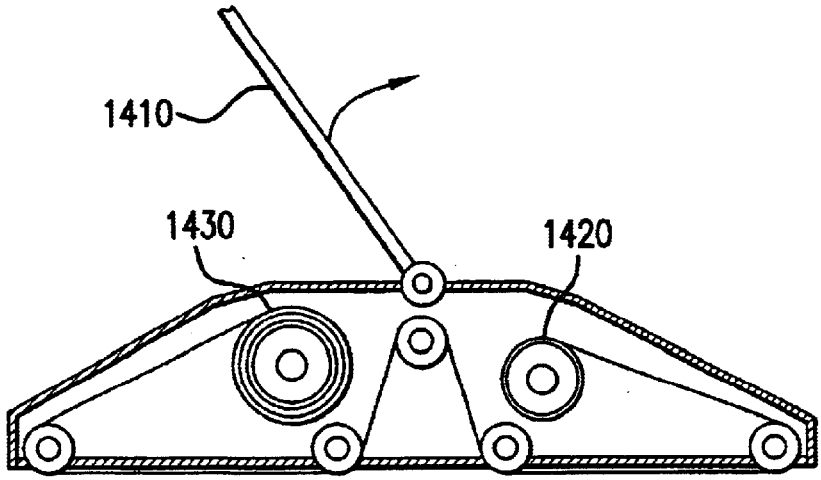
FIG. 14B is a side view of an exemplary embodiment of a rolling cleaning system 1400 of the present invention reversing direction.

In FIG. 14B, the rolling cleaning device is shown after the device as been roller predominately to the right, and as a result most of the material has been advanced from the front roller 1420 to the rear roller 1430. At this point the handle 1410 would be pivoted in the direction of the arrow in FIG. 14B.

Figure 14C:
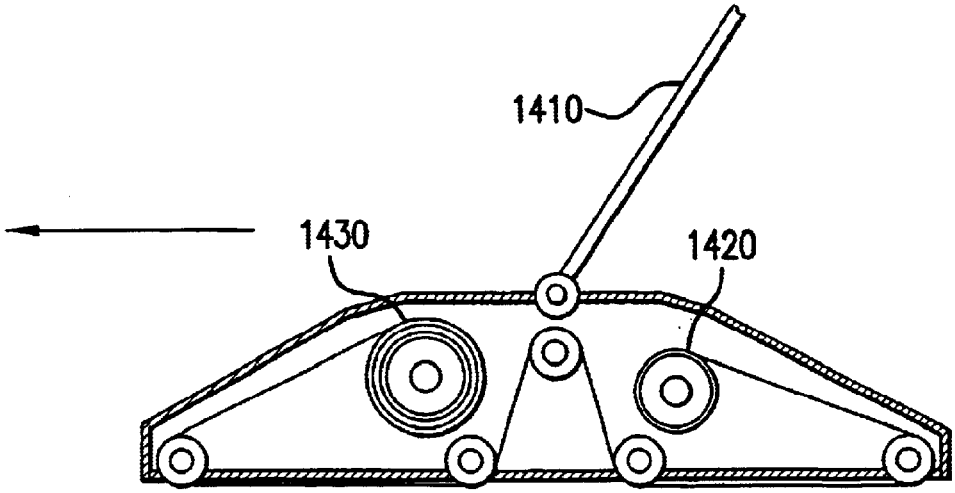
FIG. 14C is a side view of an exemplary embodiment of a rolling cleaning system 1400 of the present invention moving in a second direction.

FIG. 14C now illustrates the rolling cleaning device with handle 1410 tilted to the right and the device ready to be rolled predominately in the opposite direction with what was the rear roller 1430, now being the front roller, with most of the tacky sheet spooled up and onto it, and with what once was the front roller 1420, now being the rear roller, with little if any tacky sheet spooled there upon.

Still other advantages and embodiments of the invention will become readily apparent to those skilled in this art from the above-recited detailed description and provided drawings. Accordingly, the drawings and descriptions are to be regarded as illustrative in nature, and not as restrictive.

What is claimed is:

1. A device for cleaning a surface, comprising:

a first roller;

a second roller; aid a tacky sheet at least partially wound about said first roller and said second roller; and a brush disposed between said first roller and said second roller.

2. A device for cleaning a surface, comprising:

a first roller that, in an operative embodiment, rotates within a housing;

a second roller that, in an operative embodiment, rotates within the housing;

a sheet at least partially wound about said first roller and said second roller, said sheet having at least one tacky surface; and a brush disposed between said first roller and said second roller.

3. A device for cleaning a surface, comprising:

a sheet at least partially wound about a first roller and a second roller, said sheet having at least one tacky surface, wherein, in an operative embodiment, said first roller and said second roller rotate within a housing when the housing is moved across a surface to be cleaned;

and wherein a brush is disposed between said first roller and said second roller.

4. A device for cleaning a surface, comprising:

a sheet having at least one tacky surface; and a plurality of rollers in contact with said sheet, said plurality of rollers, in an operative embodiment, maintaining contact between said tacky surface and the surface to be cleaned; and at least one brush disposed between at least two of said plurality of rollers.

5. The device of claim 4, wherein, in an operative embodiment, said plurality of rollers are at least partially surrounded by a housing.

6. The device of claim 4, further comprising a housing at least partially surrounding said plurality of rollers.

7. The device of claim 4, further comprising:

a housing at least partially surrounding said plurality of rollers; and a handle attached to said housing.

8. The device of claim 4, further comprising:

a housing at least partially surrounding said plurality of rollers; and a handle pivotably attached to said housing.

9. The device of claim 4, further comprising:

a housing at least partially surrounding said plurality of rollers; and a handle rotatably attached to said housing.

10. The device of claim 4, further comprising:

a housing at least partially surrounding said plurality of rollers; and said brush, in an operative embodiment, sweeping the surface to be cleaned.

11. The device of claim 4, further comprising at least one take-up roller in contact with said sheet, said take-up roller, in an operative embodiment, removing slack from said sheet.

12. The device of claim 4, wherein said tacky surface of said sheet is constructed with an adhesive.

13. The device of claim 4, wherein said tacky surface of said sheet is constructed with an acrylic-based adhesive.

14. The device of claim 4, wherein said tacky surface of said sheet is constructed with an adhesive selected from a group consisting of: natural rubber in the presence of a plasticizer mixed with a hydrocolloid gum, synthetic rubber in the presence of a plasticizer mixed with a hydrocolloid gum, a co-polymer of 2-amino ethyl ethacrylate, and n-butyl methacrylate.

15. The device of claim 4, wherein said plurality of rollers are spring-loaded.

16. The device of claim 4, wherein said plurality of rollers are rigid.

17. The device of claim 4, wherein said plurality of rollers are compressible.

18. The device of claim 4, wherein said plurality of rollers are constructed from compressible foam.

* * * * *